United States Patent [19]

Scharf

[11] Patent Number: 4,564,957

[45] Date of Patent: Jan. 21, 1986

[54] BABY BOTTLE SECURITY GARMENT

[76] Inventor: Ruth Scharf, 301 E. 48th St., New York, N.Y. 10017

[21] Appl. No.: 614,212

[22] Filed: May 25, 1984

[51] Int. Cl.[4] ..... A41B 13/10; A41D 11/00

[52] U.S. Cl. ..... 2/75; 2/49 R; 2/94; 2/DIG. 6; 2/DIG. 7; 224/148; 248/102

[58] Field of Search ..... 2/46, 48–51, 2/75, 94, DIG. 6, DIG. 7; 224/148, 901; 248/102

[56] References Cited

U.S. PATENT DOCUMENTS

| | | | |
|---|---|---|---|
| 298,985 | 5/1884 | Kimball | 224/148 X |
| 2,651,039 | 9/1953 | Tonkens et al. | 2/49 R |
| 3,065,944 | 11/1962 | Liebendorfer | 224/148 X |
| 3,428,962 | 2/1969 | Slimovitz | 2/51 X |
| 3,543,976 | 12/1970 | Ronald | 224/148 |
| 4,096,977 | 6/1978 | Barville et al. | 224/148 |
| 4,220,302 | 9/1980 | Hampton et al. | 224/148 X |
| 4,272,852 | 6/1981 | Bell | 2/94 |
| 4,473,907 | 10/1984 | Maillard | 2/49 R |

*Primary Examiner*—Werner H. Schroeder
*Assistant Examiner*—J. L. K. Olds
*Attorney, Agent, or Firm*—Blum, Kaplan, Friedman, Silberman & Beran

[57] ABSTRACT

A baby bottle security garment is provided. The baby bottle security garment includes in combination a garment for covering at least part of the chest area of an infant, a sleeve piece for removably receiving and securing therein a baby bottle, and a strap member for securing the sleeve piece to the garment. Because of the way of securing the sleeve piece to the garment, the sleeve piece hangs from the garment and is normally positioned proximate the chest area of an infant wearing the garment when the chest area of the infant is in an upright position.

28 Claims, 12 Drawing Figures

FIG. 4
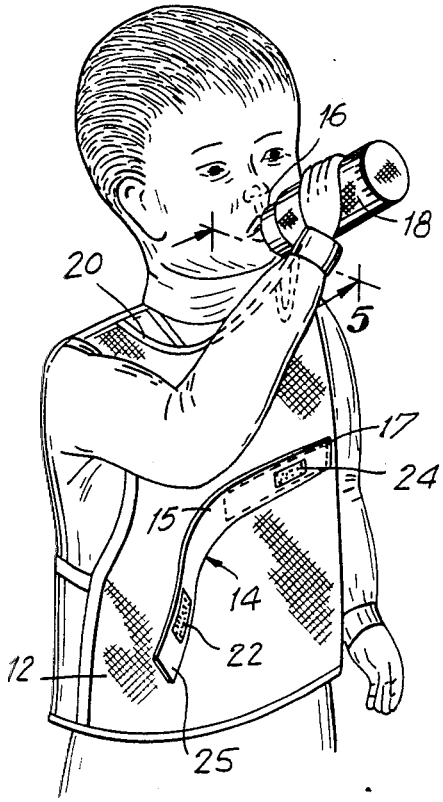
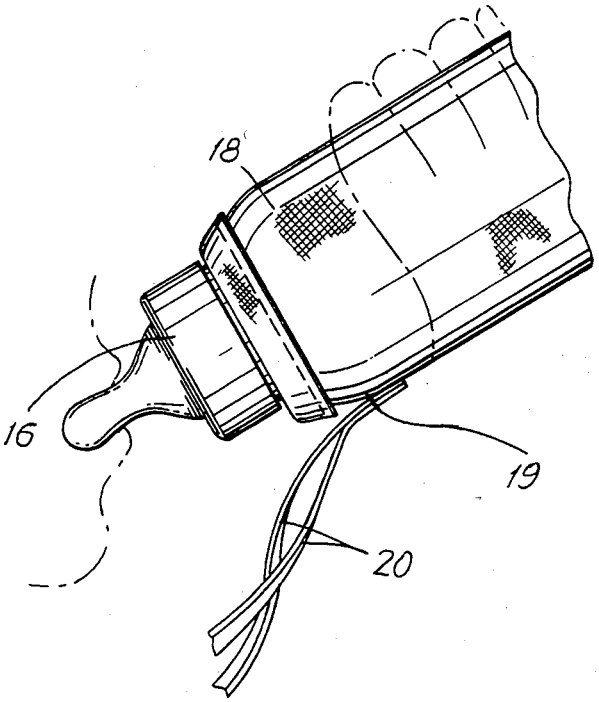
FIG. 5
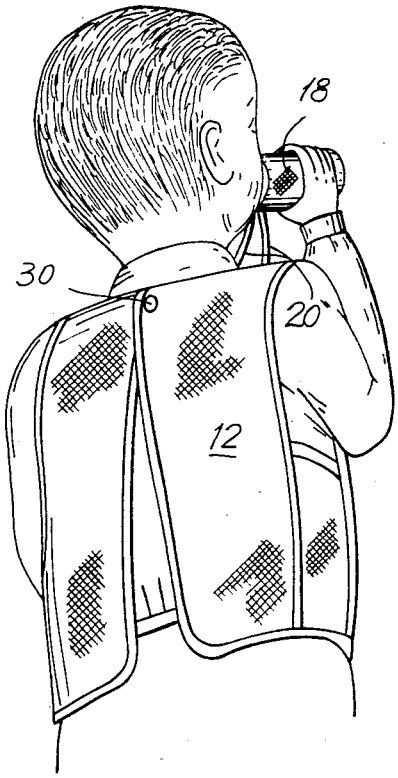
FIG. 6

BABY BOTTLE SECURITY GARMENT

BACKGROUND OF THE INVENTION

The present invention is generally directed to infant's garments and, in particular, to a baby bottle security garment which secures a baby's bottle to the garment and which prevents a baby bottle from falling away from an infant's grasp when the bottle is not secured to the garment.

Baby bottles are used by infants to drink liquids. However the infant's lack of coordination causes the baby bottle to fall from its grasp and requires an adult to pick it up, clean, or replace the nipple, and return it into the infant's mouth or hands. There is a need for providing a baby bottle security garment which can secure the baby bottle in place on the infant's chest, within reach of the infant's arms, while not in use, and prevent the bottle from falling away from the infant's grasp when the infant is not drinking from it. Accordingly, a baby bottle security garment that is worn by the infant over at least the chest and which secures and positions the baby bottle is desired.

SUMMARY OF THE INVENTION

Generally speaking, in accordance with the instant invention, a baby bottle security garment is provided. A garment is provided for covering at least part of the chest area of an infant. A sleeve receives and secures therein a baby bottle. At least one strap secures the sleeve to the garment and positions the bottle proximate to the chest area of an infant wearing the garment when the chest area of the infant is in an upright position.

In an exemplary embodiment of the invention, a sleeve retaining assembly is provided in addition to the strap. The sleeve retaining assembly is secured to the garment and releasably secures the sleeve and maintains the baby bottle disposed therein in an upright position against the garment when the infant's chest area is in an upright position.

Accordingly, an object of the present invention is to provide an improved infant's garment for feeding and play purposes.

A further object of the present invention is to provide an infant's garment which will securely hold a baby bottle.

Still a further object of the present invention is to provide an improved infant's garment which allows a baby bottle to hang freely, though within reach of an infant's grasp.

Still other objects and advantages of the invention will in part be obvious and will in part be apparent from the specification and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a perspective view of a baby bottle security garment illustrated in FIGS. 1-3 when an infant is drinking from the baby bottle;

FIG. 5 is a cross-sectional view taken along line 5—5 of FIG. 4;

FIG. 6 is a rear perspective view of the rear of a baby bottle security garment constructed in accordance with a preferred embodiment of the present invention;

DETAILED DESCRIPTION OF THE PREFERRED EMBODIMENTS

Figure 1:
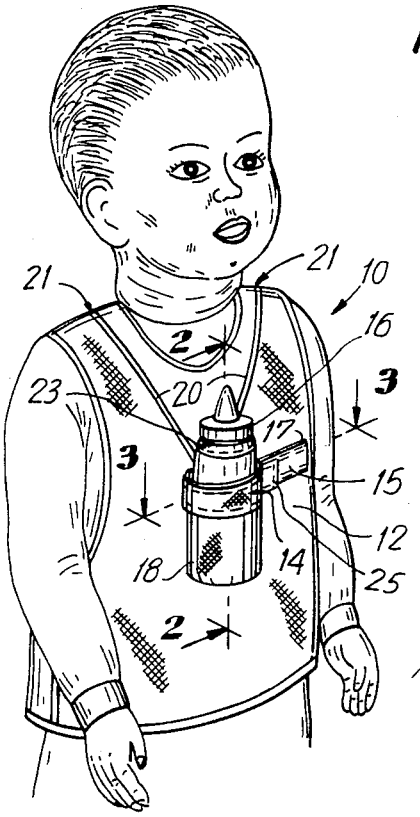
FIG. 1 is a perspective view of the baby bottle security garment, constructed in accordance with a preferred embodiment of the present invention.
Figure 2:
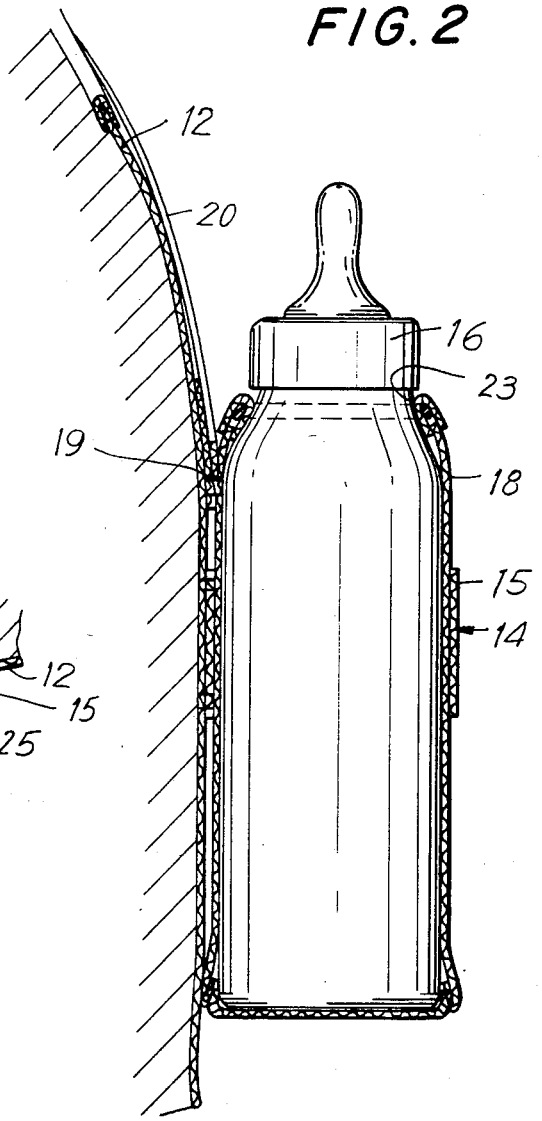
FIG. 2 is a cross-sectional view taken along line 2—2 of FIG. 1.
Figure 3:
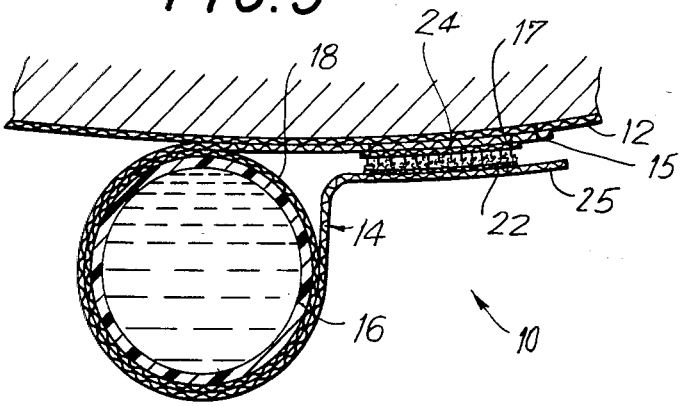
FIG. 3 is a cross-sectional view taken along line 3—3 of FIG. 1.

Reference is first made to FIGS. 1, 2 and 3, wherein a baby bottle security garment assembly, generally indicated as 10, and constructed in accordance with an exemplary embodiment of the present invention, is depicted. Security garment assembly 10 includes a garment 12 in the form of a vest or sleeveless jacket. Two thin elongated straps 20 are stitched to the garment at or around shoulder area 21. The other ends of straps 20 are secured to a baby bottle retaining sleeve 18 by, for example, stitching, at 19 (FIG. 5). Sleeve 18 includes an opening 23 therein and is configured to receive and secure therein baby bottle 16. Although sleeve 18 is sized to secure a baby bottle therein, it is further sized to permit the baby bottle to be removed therefrom, but with sufficient difficulty to prevent such removal by an infant. Straps 20 are stitched to sleeve 18 at or proximate to the opening 23 of sleeve 18 in order to assure that sleeve 18 hangs in an upright position when the infant is also in an upright position of the type illustrated in FIG. 1.

In addition to the straps 20, a sleeve retaining assembly, generally indicated as 14, is secured to the chest area of the garment at or near the position where sleeve 18 hangs freely from the garment. Retaining assembly 14 includes an elongated belt 15, which belt is sewn at first end thereof 17 to garment 12. A first VELCRO® fastener 24 is secured to the first end 17 of belt 15. A second VELCRO fastener 22 is secured at a second, free end 25 of belt 15. The distance between first and second VELCRO fasteners 24 and 22, is sufficient to permit belt 15 to wrap around sleeve 18, when a bottle 16 is inserted therein, and bring into registry first and second VELCRO fasteners 24 and 22, in the manner illustrated in FIG. 3. When belt 15 is wrapped around sleeve 18, and second VELCRO fastener 22 at free end 25 thereof is secured to first VELCRO fastener 24, bottle 16 is firmly positioned in an upright manner against the chest area of the infant.

When second fastener 22 is released and belt 15 is opened, bottle 16 is permitted to freely hang about the chest area thereby permitting an infant to freely grasp baby bottle 16 and drink from it in the manner illustrated in FIG. 4. Alternatively, when the child releases the bottle from its grasp, straps 20 assure that bottle 16 is returned to a normal upright position near the infant's chest. Straps 20 prevent the bottle from falling to the floor or out of the child's reach.

Baby bottle security garment 10 also provides play value for infants of suitable age and coordination allowing them to attach and detach baby bottle 16 and baby bottle sleeve 18. Thin straps 20 prevent baby bottle 16 and sleeve 18 from moving out of the infant's reach. This makes it easier for the infant to grasp and control the baby bottle. The infant can do this while sitting in a stroller or even walking around as it is less likely that baby bottle will fall to the ground.

Reference is next made to FIG. 6 wherein garment 12 is shown from the rear. The garment can be held closed by buttons, clasps, or buckles 30 or any other type of garment closure. Buckle 30 is placed on the rear of garment 12 so as to prevent the child from accidentally removing the garment.

Figure 7:
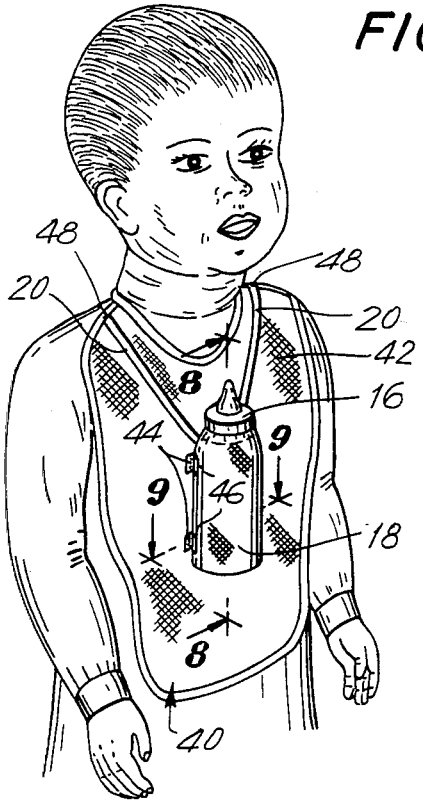
FIG. 7 is a perspective view of an alternate embodiment of a baby bottle security garment constructed in accordance with the present invention.
Figure 8:
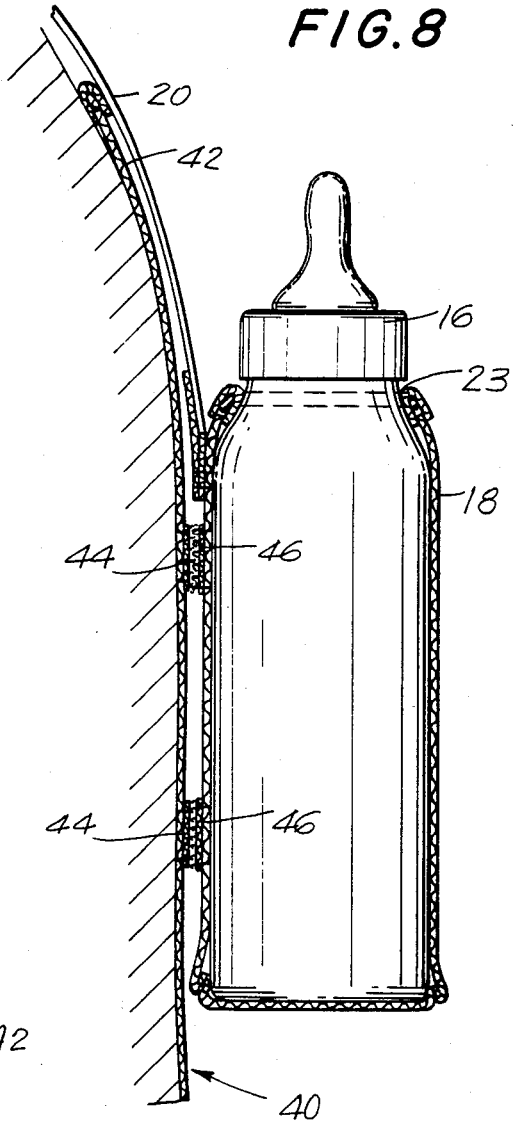
FIG. 8 is a cross-sectional view taken along line 8—8 of FIG. 7.
Figure 9:
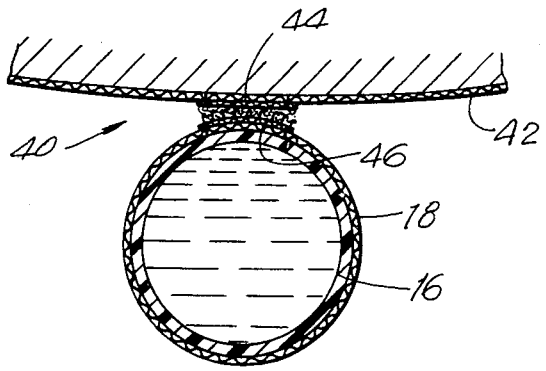
FIG. 9 is a cross-sectional view taken along line 9—9 of FIG. 7.

Reference is next made to FIGS. 7, 8 and 9 wherein an alternate embodiment of the baby bottle security garment, generally indicated as 40 is depicted, like reference numerals being used to depict like elements. Baby bottle security garment 40 includes a bib 42 having two VELCRO patches 44 on the front of bib 42. Sleeve 18 has two VELCRO patches 46 secured thereto. When VELCRO patches 46 are pressed against VELCRO patches 44, sleeve 18 is securely adhered to bib 42. The number and size of the VELCRO patches can vary. One patch on bib 42 and sleeve 18 is sufficient, but two or more provides greater stability and further cause the bottle to be disposed in an upright position when the infant is wearing the bib. Sleeve 18 is attached by thin straps 20 to bib 42 at top seam 48.

When VELCRO patches 44 and 46 are in contact, baby bottle sleeve 18 and baby bottle 16 are securely attached to bib 42. When baby bottle sleeve 18 is pulled away from bib 42, VELCRO patches 44 and 46 are separated. Nevertheless sleeve 18 remains attached to the bib 42 by straps 20. When VELCRO patches 44 and 46 are not in contact, the child can drink from baby bottle 16 or allow it to hang freely in the same manner noted above.

Figure 10:
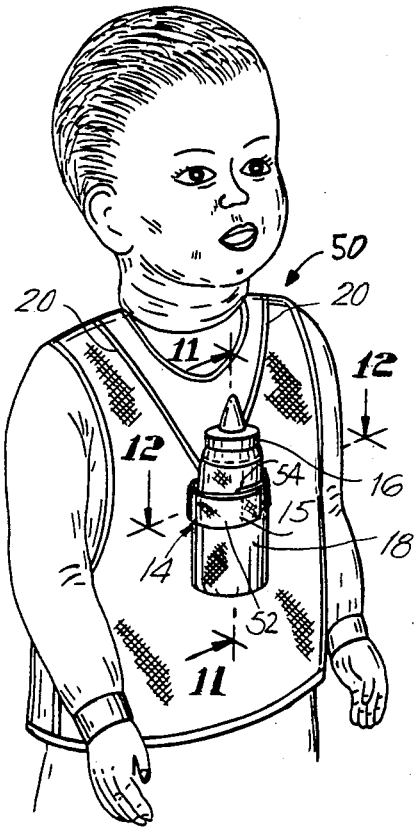
FIG. 10 is a perspective view of another embodiment of a baby bottle security garment constructed in accordance with the present invention.
Figure 11:
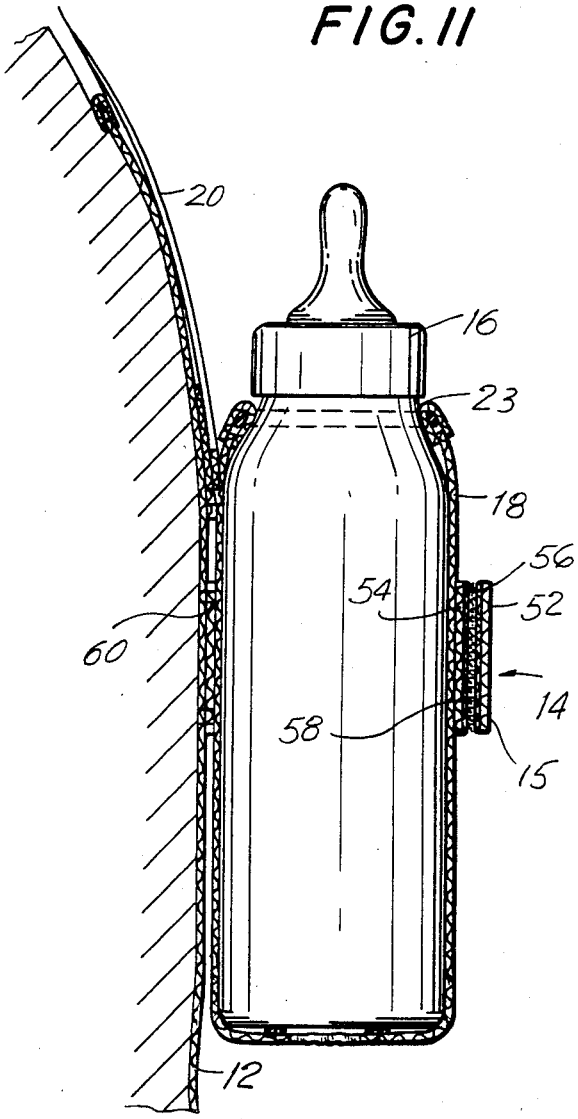
FIG. 11 is a cross-sectional view taken along line 11—11 of FIG. 10.
Figure 12:
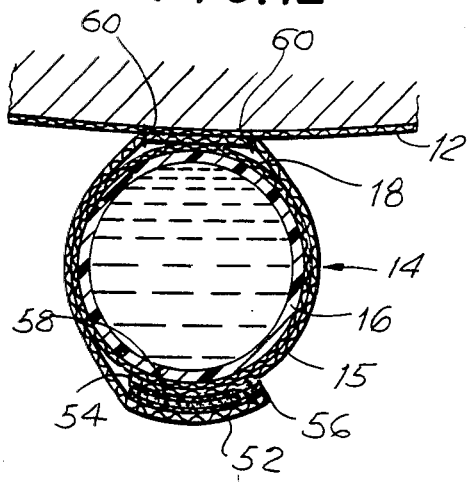
FIG. 12 is a cross-sectional view taken along line 12—12 of FIG. 10.

Reference is next made to FIGS. 10, 11 and 12 wherein another embodiment of the baby bottle security garment, generally indicated as 50 is depicted, like reference numerals being used to depict like elements. Baby bottle security garment 50 includes a garment 12, which may be a sleeveless vest. Baby bottle 16 and baby bottle sleeve 18 are securely attached to garment 12 by a retaining assembly generally indicated as 14. Retaining assembly 14 includes an elongated belt 15 which is attached to garment 12 at area 60 near the center of belt 15. Belt 15 may be attached to garment 12 by either sewing or with an adhesive.

Strap 15 has a first free end 52 and a second free end 54. Free end 52 has a first VELCRO fastener 56 and second free end 54 has a second VELCRO fastener 58. First VELCRO fastener 56 is placed on a first side of strap 15 and second VELCRO fastener 58 is placed on the other side of strap 15 so that when free ends 52, 54 of strap 15 encircle baby bottle 16 and baby bottle sleeve 18 first VELCRO fastener 56 and second VELCRO fastener 58 are in registry.

When VELCRO fasteners 56 and 58 are in contact, baby bottle sleeve 18 and baby bottle 16 are securely attached to garment 12. When free end 52 is pulled outward and first VELCRO fastener 56 is separated from second VELCRO fastener 58, baby bottle 16 is permitted to freely hang about the chest area as it is held by strap 20. In this position an infant can freely grasp baby bottle 16 or allow it to hang freely in the same manner as noted above.

Any type of garment such as a vest or bib which covers the chest of an infant may be suitable for use as a baby bottle security garment. Either a strap or contact patches can be used to secure the baby bottle holder to any garment.

Accordingly, the present invention provides a baby bottle security garment, which securely attaches the baby bottle to the garment, but which also allows the baby bottle to hang freely, though within the child's reach. The baby bottle security garment is also useful for play value, as an infant, of suitable age and coordination, can repeatedly attach and detach the baby bottle from the garment without dropping or spilling the contents of its baby bottle.

It will thus be seen that the object set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which as a matter of language, might be said to fall therebetween.

What is claimed is:

1. A baby bottle security garment comprising, in combination:

garment means for covering at least part of the chest area of an infant;

sleeve means for removably receiving and securing therein a baby bottle; and strap means for securing said sleeve means to said garment means so that said sleeve means hangs from said garment and is normally positioned proximate the chest area of an infant wearing the garment when the chest area of the infant is in an upright position, wherein the strap means includes at least one strap for connecting the garment means to the sleeve means.

2. A baby bottle security garment, as claimed in claim 1, and including sleeve retaining means secured to said garment means and cooperatively associated with said sleeve means for releasably securing said sleeve means in a predetermined position against said garment means.

3. A baby bottle security garment, as claimed in claim 1, wherein the garment means is a sleeveless vest.

4. A baby bottle security garment, as claimed in claim 1, wherein the garment means is a bib.

5. A baby bottle security garment, as claimed in claim 1, wherein said strap means includes two straps, each of which is attached at a first end to the sleeve means and each of which is attached at its second end at or about opposed sides of the neck area of the garment means.

6. A baby bottle security garment, as claimed in claim 2, wherein the sleeve retaining means includes a belt having a first end attached to the garment means and a second, free end, and fastening means for securing said free end to said first end when the belt is wrapped around said sleeve means.

7. A baby bottle security garment, as claimed in claim 6, wherein the fastening means includes a first hook and pile connector patch attached to the fixed end of the belt and a second hook and pile connector patch attached to the free end of the belt.

8. A baby bottle security garment, as claimed in claim 1, wherein the strap means are coupled to the sleeve means at or about the top of the sleeve means so that an upright configuration is obtained.

9. A baby bottle security garment, as claimed in claim 2, wherein the sleeve retaining means includes at least one first hook and pile connector patch coupled to the garment means and at least one second hook and pile connector patch attached to the sleeve means.

10. A baby bottle security garment, as claimed in claim 2, wherein the sleeve retaining means includes two first hook and pile connector patches arranged one above the other on the garment means; and two second hook and pile connector patches coupled to the sleeve means so as to contact the two first hook and pile connector patches when the sleeve means is urged against the garment means.

11. A baby bottle security garment, as claimed in claim 2, wherein the strap means are coupled to the sleeve means at or about the top of the sleeve means so that an upright configuration is obtained.

12. A baby bottle security garment, as claimed in claim 2, wherein the sleeve retaining means comprises a belt secured to the garment means, said belt having a first free end, a second free end and connection means for connecting the first free end to the second free end when the first free end and the second free end encircle the baby bottle and are in registry.

13. A baby bottle security garment, as claimed in claim 12, wherein the belt is secured to the garment means proximate to the center of the belt.

14. A baby bottle security garment, as claimed in claim 12, wherein the connection means includes a first hook and pile connector patch attached to the first free end on a first side of the belt and a second hook and pile connector patch attached to the second free end of the belt on the second side of the belt, said first and second sides being opposite sides of the belt.

15. A baby bottle security garment, comprising:

garment means for covering at least part of the chest area of an infant;

sleeve means for removably receiving and securing therein a baby bottle; and sleeve retaining means secured to said garment means and cooperatively associated with said sleeve means for releasably securing said sleeve means in a predetermined position against said garment means.

16. A baby bottle security garment, as claimed in claim 15, wherein the sleeve retaining means includes a belt having a first end attached to the garment means and a second, free end, and fastening means for securing said free end to said first end when the belt is wrapped around said sleeve means.

17. A baby bottle security garment, as claimed in claim 16, wherein the fastening means includes a first hook and pile connector patch attached to the fixed end of the belt and a second hook and pile connector patch attached to the free end of the belt.

18. A baby bottle security garment, as claimed in claim 15, wherein the sleeve retaining means includes at least one first hook and pile connector patch coupled to the garment means and at least one second hook and pile connector patch attached to the sleeve means.

19. A baby bottle security garment, as claimed in claim 15, wherein the sleeve retaining means comprises a belt secured to the garment means, said belt having a first free end, a second free end and connection means for connecting the first free end to the second free end when the first free end and the second free end encircle the baby bottle and are in registry.

20. A baby bottle security garment, as claimed in claim 19, wherein the belt is secured to the garment means proximate to the center of the belt.

21. A baby bottle security garment, as claimed in claim 19, wherein the connection means includes a first hook and pile connector patch attached to the first free end on a first side of the belt and a second hook and pile connector patch attached to the second free end of the belt on a second side of the belt, said first and second sides being opposite sides of the belt.

22. A baby bottle security garment, comprising:

garment means for covering at least part of the chest area of an infant;

sleeve means for removably receiving and securing therein a baby bottle;

strap means for securing said sleeve means to said garment so that said sleeve means hangs from said garment and is normally positioned proximate the chest area of an infant wearing the garment when the chest area of the infant is in an upright position; and sleeve retaining means secured to said garment means and cooperatively associated with said sleeve means for releasably securing said sleeve means in a predetermined position against said garment means.

23. A baby bottle security garment, as claimed in claim 22, wherein the strap means are coupled to the sleeve means at or about the top of the sleeve means so that an upright configuration is obtained.

24. A baby bottle security garment, as claimed in claim 22, wherein the sleeve retaining means comprises a belt secured to the garment means, said belt having a first free end, a second free end and connection means for connecting the first free end to the second free end when the first free end and the second free end encircle the baby bottle and are in registry.

25. A baby bottle security garment, as claimed in claim 24, wherein the belt is secured to the garment means proximate to the center of the belt.

26. A baby bottle security garment, as claimed in claim 24, wherein the connection means includes a first hook and pile connector patch attached to the first free end on a first side of the belt and a second hook and pile connector patch attached to the second free end of the belt on a second side of the belt, said first and second sides being opposite sides of the belt.

27. A baby bottle security garment, as claimed in claim 22, wherein the sleeve retaining means includes a belt having a first end attached to the garment means and a second, free end, and fastening means for securing said free end to said first end when the belt is wrapped around the sleeve means.

28. A baby bottle security garment, as claimed in claim 27, wherein the fastening means includes a first hook and pile connector patch attached to the first end of the belt and a second hook and pile connector patch attached to the free end of the belt.

* * * * *